US011426321B2

(12) United States Patent
Reck

(10) Patent No.: US 11,426,321 B2
(45) Date of Patent: Aug. 30, 2022

(54) DEVICE FOR HEIGHT ADJUSTMENT

(71) Applicant: ANTON RECK E.K., Betzenweiler (DE)

(72) Inventor: Christine Reck, Biberach (DE)

(73) Assignee: ANTON RECK E.K., Betzenweiler (DE)

( * ) Notice: Subject to any disclaimer, the term of this patent is extended or adjusted under 35 U.S.C. 154(b) by 300 days.

(21) Appl. No.: 16/647,134

(22) PCT Filed: Sep. 18, 2018

(86) PCT No.: PCT/EP2018/075169
§ 371 (c)(1),
(2) Date: Mar. 13, 2020

(87) PCT Pub. No.: WO2019/063359
PCT Pub. Date: Apr. 4, 2019

(65) Prior Publication Data

US 2021/0022941 A1 Jan. 28, 2021

(30) Foreign Application Priority Data

Sep. 26, 2017 (DE) ..... 102017122295.2

(51) Int. Cl.
*A61H 1/02* (2006.01)

(52) U.S. Cl.
CPC ..... *A61H 1/0214* (2013.01); *A61H 1/0274* (2013.01); *A61H 2201/0192* (2013.01);
(Continued)

(58) Field of Classification Search
CPC ..... A61H 1/0214; A61H 1/0274; A61H 2201/0192; A61H 2201/1635; A61H 2201/164; A61H 2201/1671; A61H 2201/5043; A61H 2203/0425; A61H 2203/0443; A61H 1/0237; A61H 2201/1215; A61H 2201/1261; A61H 2201/50; A61H 2203/0431; A61H 2203/045; A61H 2205/06; A61H 2205/10; A61H 1/0277; A61H 1/0281;
(Continued)

(56) References Cited

U.S. PATENT DOCUMENTS 4,572,501 A * 2/1986 Durham ..... A63B 22/001 601/36
4,673,178 A * 6/1987 Dwight ..... A63B 22/0605 482/57
(Continued)

FOREIGN PATENT DOCUMENTS

DE 202007013828 U1 12/2007
EP 0337297 A1 10/1989

*Primary Examiner* — Garrett K Atkinson
(74) *Attorney, Agent, or Firm* — Slater Matsil, LLP

(57) ABSTRACT

A physiotherapeutic device is disclosed. In an embodiment a physiotherapeutic device includes an arm trainer configured to rotationally move arms of a patient, the arm trainer having a first axis and a leg trainer configured to rotationally move legs of the patient, the leg trainer having a second axis, wherein the first and second axes comprise an adjustability in height, wherein a distance of the first axis to the second axis is constant, wherein the arm and leg trainers are adjustable in height so that an adjustment in height results in different exercising positions.

16 Claims, 4 Drawing Sheets

(52) U.S. Cl.
CPC ..... *A61H 2201/164* (2013.01); *A61H 2201/1635* (2013.01); *A61H 2201/1671* (2013.01); *A61H 2201/5043* (2013.01); *A61H 2203/0425* (2013.01); *A61H 2203/0443* (2013.01)

(58) Field of Classification Search
CPC ..... A63B 21/00178; A63B 21/00181; A63B 22/0005; A63B 71/0619; A63B 2071/0694; A63B 2208/0228; A63B 2208/0233; A63B 2208/0242; A63B 2208/0247; A63B 2225/09; A63B 2225/093; A63B 2225/50; A63B 22/001; A63B 21/0058; A63B 22/0012; A63B 22/0046; A63B 22/0605
See application file for complete search history.

(56) References Cited

U.S. PATENT DOCUMENTS 4,846,156 A * 7/1989 Kopnicky ..... A63B 22/0694 601/36
4,902,002 A * 2/1990 Huang ..... A63B 22/0005 482/62
4,976,426 A * 12/1990 Szabo ..... A63B 22/0002 601/36
5,044,627 A * 9/1991 Huang ..... A63B 22/0012 482/115
5,342,262 A * 8/1994 Hansen ..... A63B 22/0605 482/62
5,569,128 A * 10/1996 Dalebout ..... A63B 22/0005 482/57
5,785,631 A 7/1998 Heidecke
5,857,943 A * 1/1999 Murray ..... A63B 22/0605 482/57
5,980,431 A * 11/1999 Miller, Jr. ..... A63B 22/0012 482/57
6,036,623 A * 3/2000 Mitchell ..... A63B 23/03575 482/57
6,840,892 B1 * 1/2005 Wu ..... A63B 22/0005 482/62
7,789,808 B2 * 9/2010 Lee ..... A63B 22/0007 482/57
8,562,488 B2 * 10/2013 Alberts ..... A63B 24/0087 482/901
8,968,162 B2 * 3/2015 Jaguan ..... A63B 21/4035 482/57
9,592,421 B2 * 3/2017 Eder ..... A63B 23/12
9,636,539 B1 * 5/2017 Brumit ..... A61H 1/0237
10,010,745 B1 * 7/2018 Brumit ..... A63B 22/0005
10,426,996 B1 * 10/2019 Brumit ..... A61H 1/0214
10,493,319 B2 * 12/2019 Velert ..... A63B 22/001
2006/0094569 A1 * 5/2006 Day ..... A63B 24/00 482/57
2007/0129219 A1 * 6/2007 Mahlberg ..... A61H 1/0237 482/57
2008/0085819 A1 * 4/2008 Yang ..... A63B 22/0605 482/57
2011/0082397 A1 * 4/2011 Alberts ..... A63B 24/0087 482/8
2013/0130798 A1 * 5/2013 Nir ..... A63F 13/803 463/36
2015/0306451 A1 * 10/2015 Arnold ..... A63B 22/001 482/52
2016/0206915 A1 * 7/2016 Velert ..... A63B 22/0005
2018/0221705 A1 * 8/2018 Solodovnik ..... A63B 22/0664
2018/0228682 A1 * 8/2018 Bayerlein ..... A63B 71/0622
2019/0070453 A1 * 3/2019 Kiani ..... A63B 22/001

* cited by examiner

DEVICE FOR HEIGHT ADJUSTMENT

CROSS-REFERENCE TO RELATED APPLICATIONS

This patent application is a national phase filing under section 371 of PCT/EP2018/075169, filed Sep. 18, 2018, which claims the priority of German patent application 102017122295.2, filed Sep. 26, 2017, each of which is incorporated herein by reference in its entirety.

TECHNICAL FIELD

The present invention concerns a physiotherapeutic device for treatment of a patient by means of physical movement.

BACKGROUND

In prior art ergometers, sports devices and physiotherapeutic devices are known, which can help a person in rehabilitation, for example after a stroke.

SUMMARY

Physiotherapeutic devices serve the rehabilitation of ill people. Advantageously such devices are characterized in that various regions of the body can be exercised with such a device. Also operability should be easy, so that the device can be operated and/or adjusted by the patient themselves and/or that a trained specialist, such as a nurse or a caregiver, can quickly reconfigure the equipment or the device.

Embodiments provide a device with a high variability and easy operability.

As a first embodiment of the invention a physiotherapeutic device for treatment of a patient by means of physical movement is provided, comprising: an arm trainer for rotational movement of the arms of the patient, having a first axis, and a leg trainer for rotational movement of the legs of the patient, having a second axis, wherein the first and the second axis have an adjustability in height, wherein the distance of the first axis to the second axis is constant.

Due to a constant distance, sitting and lying exercising positions can be made possible, whereby different regions of the body can be exercised.

As a second embodiment of the invention a method for physiotherapeutical treatment of a patient by means of movement with a device according to any one of claims 1 to 8 is provided, comprising the steps: exercising the arms by means of an arm trainer and/or exercising the legs by means of a leg trainer in a sitting position and exercising the arms by means of an arm trainer and/or exercising the legs by means of a leg trainer in a lying position.

Exemplary embodiments are described in the dependent claims.

In a further embodiment of the invention a device is provided, wherein the device has a display for showing the status of the device and/or the physical condition of the patient, wherein the display is pivotable toward the longitudinal axis of the device.

By means of a pivotable display firstly an optimal display angle can be selected. In addition the display can be pivoted for transport, whereby it is less extensive and a suitable compact transport size results.

According to a further exemplary embodiment of the invention a device is provided, wherein the adjustability in height is enabled by a first and a second element or by third single element.

A third single element can combine the functions of clamping and clicking into place in one operating element, whereby an easy operability results.

In yet another embodiment of the invention a device is provided, wherein the device comprises a foot element and a body element, wherein the arm trainer and the leg trainer are disposed on the body element and/or wherein the adjustability in height results from moving the foot element relative to the body element.

According to an exemplary embodiment of the invention a device is provided, wherein the first element is suited for clamping the foot element with the body element and/or wherein the second element is provided for clicking into place the foot element with the body element.

By means of the configuration of two independent elements for locking the height adjustment, an inadvertent "dropping to the ground" of the body element can be prevented. In particular because of an element for staggered or stepped clicking into place, a safety catch during operation of the device results. Disengaging a clamping element thus does not automatically lead to "retraction" of the device.

According to an exemplary embodiment of the invention a device is provided, wherein the first and/or the second element are color-coded and/or wherein the operating elements of the device are color-coded.

By means of color-coding an easier operability of the device results.

According to a further exemplary embodiment of the invention a device is provided, wherein the arm trainer and/or the leg trainer are rotationally movable by the patient and/or by a motor.

In yet another embodiment of the invention a device is provided, wherein the motor moves the arm trainer and/or the leg trainer at 90 revolutions per minute.

By means of a movement of the arms and/or leg sections of the patient at 90 revolutions per minute in each case, a prevention and/or treatment of Parkinson's disease can be achieved. In particular, the movement of the leg trainer at 90 revolutions per minute and/or the simultaneous movement of the arm and leg trainer at 90 revolutions per minute are advantageous in maintaining physical health or the recovery of patients suffering from Parkinson's.

According to an exemplary embodiment of the invention a method is provided, comprising the step: rotating the arm trainer and/or the leg trainer at 90 revolutions per minute.

Embodiments provide adjustability in height of the arm and leg trainer of a physiotherapeutic device. However, the distance of the two axes of the arm and leg trainer should be held constant. In this manner, with a height adjustment a different exercising position is taken in each case, whereby other body regions can be exercised. In particular, the exercising position will be changed from a sitting to a lying position.

BRIEF DESCRIPTION OF THE DRAWINGS

Further details and advantages of the invention will become apparent from the embodiments shown in the drawings.

DETAILED DESCRIPTION OF ILLUSTRATIVE EMBODIMENTS

Figure 1:
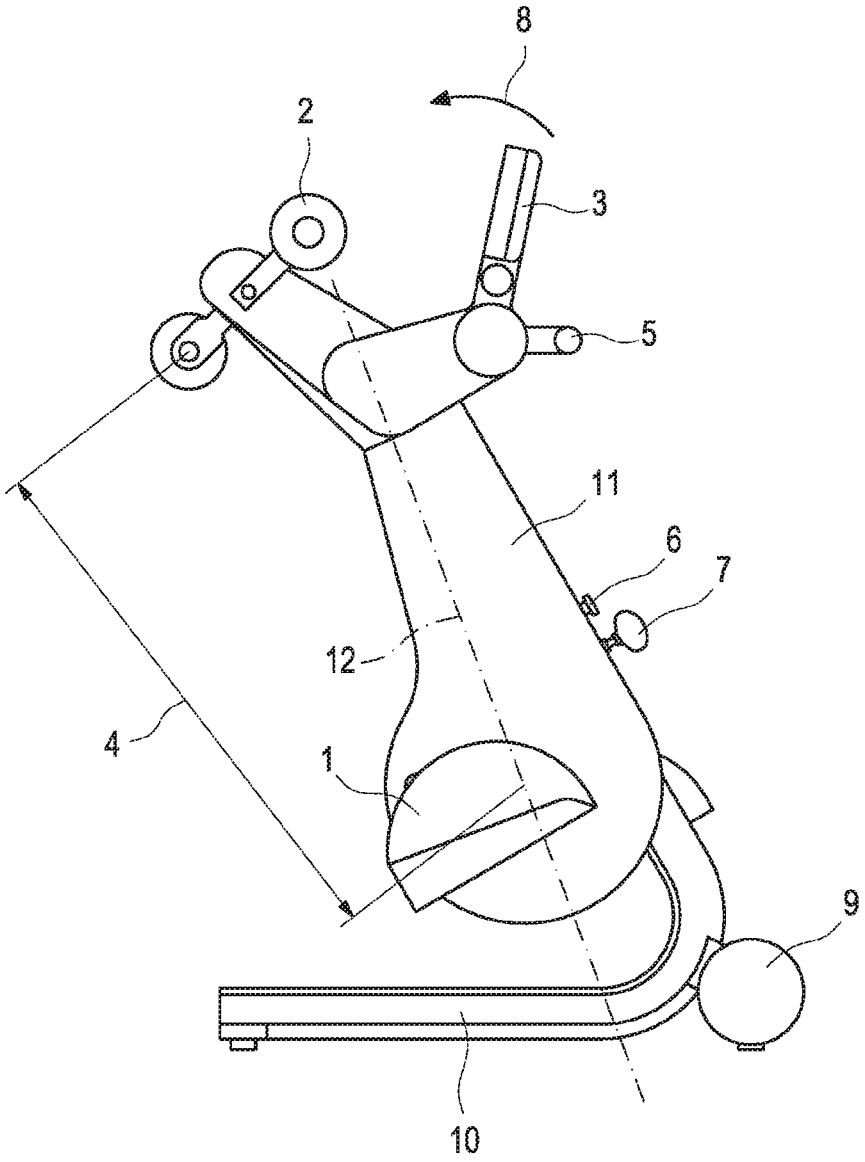
FIG. 1 shows a device in a first side view.

FIG. 1 shows a physiotherapeutic device having a leg trainer 1 and an arm trainer 2, wherein arm and leg trainers 1 and 2 each have an axis of motion. The distance 4 of said two axes is held constant during height adjustment of the arm trainer 2 and/or the leg trainer 1, so that in case of a height adjustment of the arm trainer 2 an equal height adjustment of the leg trainer 1 will always result. The same is true for height adjustment of the leg trainer 1. Thus if the arm and leg trainer 1 and 2 are adjusted upwards, a lying position for the patient will gradually arise from a sitting position. Therefore the patient can first exercise first body regions in a sitting position and exercise further different body regions in the lying position.

Additionally, the device has two operating elements 6 and 7, which ensure a locking of a selected height position. The first operating element 7 serves for causing a clamping, so that every height setting possible is enabled. The second operating element 6 can create a staggered or stepped engagement. Before a height adjustment is made, said operating element 6 has to be disengaged.

Furthermore, the device has a display 3, which can be pivoted inwards in the pivoting direction 8. Through this a better transportability can be achieved, if the device is to be rolled away by means of the transport handle 5 with the wheels 9.

The operating elements 6 and 7 of the device can be color-coded, for example orange, in order to ensure easy operability.

In particular, the device has a rotatory drive of the arm and/or leg trainer 1 and 2 with 90 revolutions per minute in each case. In particular by rotationally moving the patient's arms and legs at the same time, Parkinson's disease may be treated. In addition, the rotational movement of the legs at 90 revolutions per minute leads to a healing effect.

The device has a first element 7 and a second element 6 for height adjustment, i.e. for changing the position of the body element 11 to the foot element 10.

Here a clamping of the body element 11 to the foot element 10 via the first element 7 can be enabled. Thus because of the first element 7 any height setting can be chosen. The second element 6 is provided for engaging the body element 11 with the foot element 10. In this way, when disengaging the clamping element 7, the body element 11 is prevented from going all the way down because of the effect of gravity. Instead, in a "free fall" the detent element 6 will bring the body element 11 to a stop in stages. The detent element 6 engages in stages, if the clamping element 7 is disengaged. The detent can for example be disengaged by pulling out the detent element 6, in order to take any height position.

Figure 2:
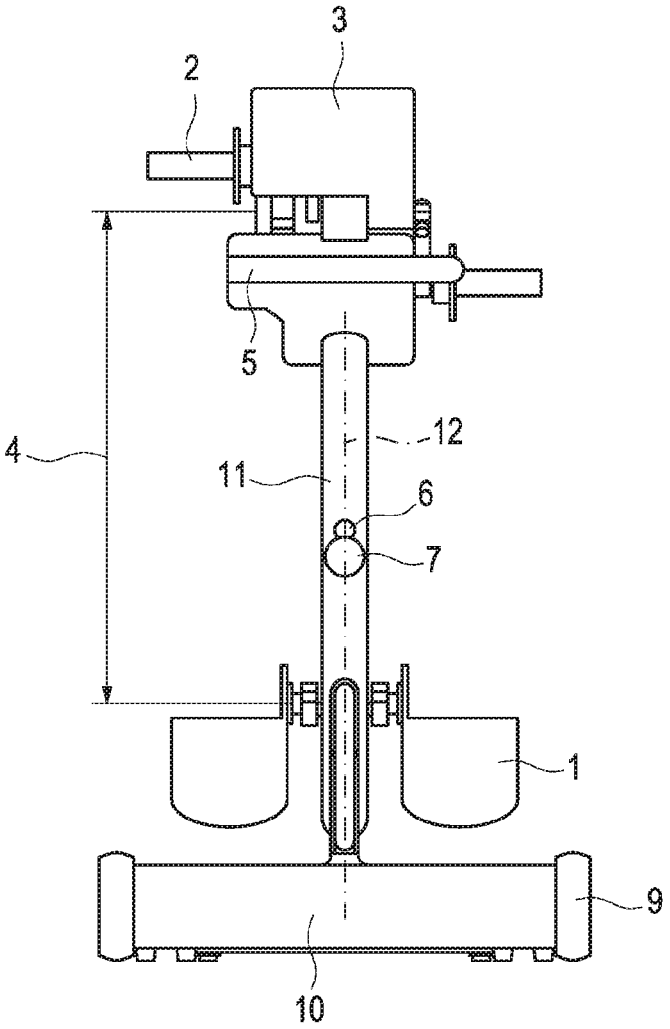
FIG. 2 shows the device in a rear view.

FIG. 2 shows the device in a view from behind, wherein the rear side of the display 3 can be seen. The device has a foot element 10 and a body element 11. Adjustability in height is made possible by the body element 11 being movable in height relative to the foot element 10. The arm trainer 2 and the leg trainer 1 are both disposed on the body element 11. Thus if the body element 11 is moved relative to the foot element 10, the trainer 2 and leg trainer 1 equally move along. In this way in a low height of the device a sitting position of the patient during exercise with the device results. If the height is adjusted, the patient gradually takes a lying position during exercise with the device and can thus train other various body regions compared to the sitting position. Through this a broadening of the scope of application of the device results.

Figure 3:
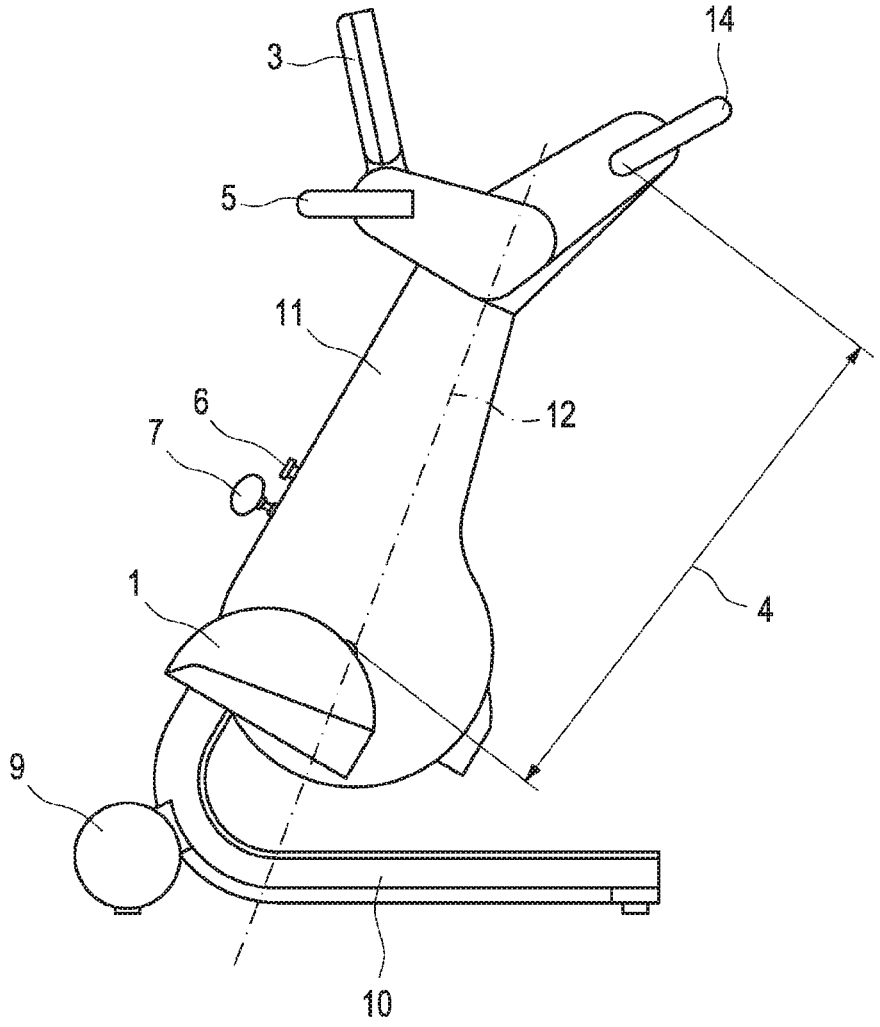
FIG. 3 shows the device in a second side view.

FIG. 3 shows the device in a further side view, wherein instead of an arm trainer a handle 14 is disposed.

Figure 4:
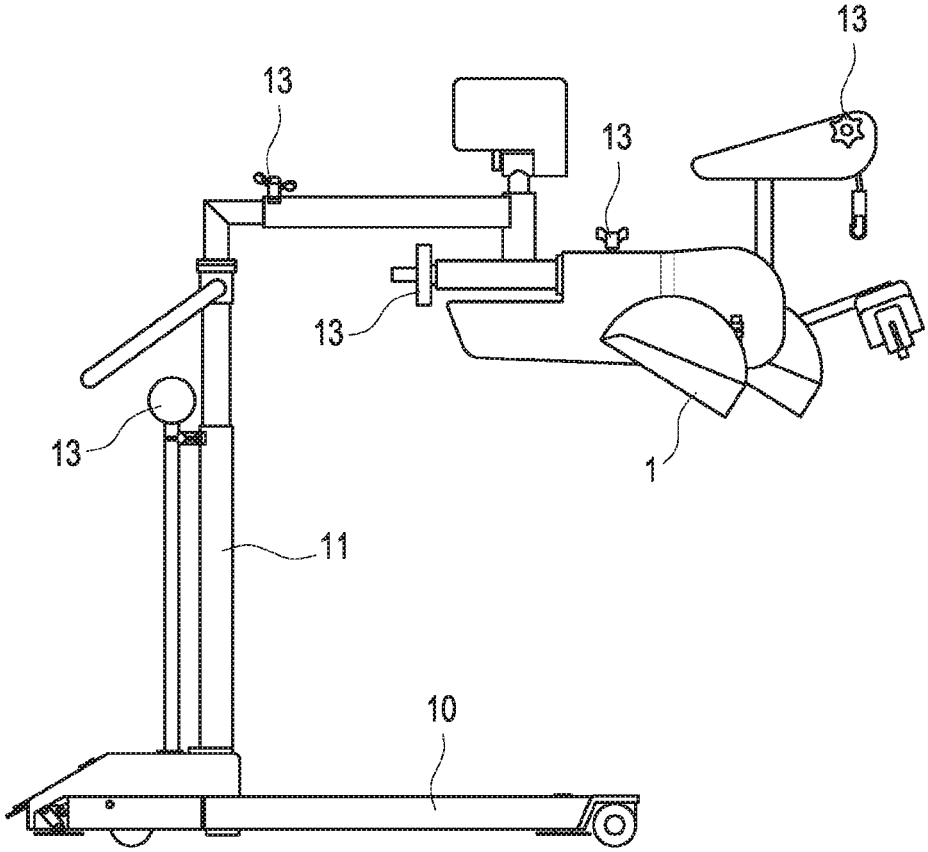
FIG. 4 shows a further embodiment.

FIG. 4 shows an alternative embodiment of the device. The operating elements 13 of the device can be color-coded, for example orange, in order to ensure easy operability.

In an alternative embodiment the device has a removable display, wherein the display is connected to the device wirelessly or via a cable.

Due to the constant distance of arm and leg trainer 1 and 2, in a first position of the patient with low height of the arm and leg trainer 1 and 2 a sitting position of the patient results, wherein the leg is bent. In a second height setting, in which a high height of the arm and leg trainer 1 and 2 is set, a lying position results, in which the leg of the patient is stretched out. This also results in the possibility to be able to let very tall patients exercise with the device, because such a position can be chosen for the patient, in which exercise with the device is made possible. Advantageously, in a lying exercising position a "dropping of the blood" can be prevented. The device therefore offers the patient the possibility to exercise according to physical condition and circumstances.

The reference numerals used are merely intended to increase comprehensibility and should in no way be regarded as restrictive, the scope of protection of the invention being represented by the claims.

LIST OF REFERENCE NUMERALS 1 leg trainer
2 arm trainer
3 display
4 distance axis leg trainer to arm trainer
5 handle
6 detent device
7 clamping device
8 pivoting direction of display 3
9 wheels
10 foot element
11 body element
12 longitudinal axis
13 operating elements
14 handle

The invention claimed is:

1. A physiotherapeutic device comprising:
an arm trainer configured to rotationally move arms of a patient, the arm trainer having a first axis; and
a leg trainer configured to rotationally move legs of the patient, the leg trainer having a second axis,
wherein a distance of the first axis to the second axis is always constant, and
wherein the first and second axes are height adjustable so that an adjustment in height results in different exercising positions.

2. The device according to claim 1, further comprising a display configured to display a status of the device and/or a physical condition of the patient, wherein the display is pivotable toward a longitudinal axis of the device.

3. The device according to claim 1, wherein an adjustability in height is enabled by a first element and a second element or by third single element.

4. The device according to claim 1, further comprising a foot element and a body element, wherein the arm trainer and the leg trainer are disposed on the body element.

5. The device according to claim 4, further comprising a first element and a second element, wherein the first element is configured to clamp the foot element to the body element, and/or wherein the second element is configured to click the foot element into place with the body element.

6. The device according to claim 5, wherein the first element and/or the second element are color-coded, and/or wherein operating elements of the device are color-coded.

7. The device according to claim 1, further comprising a foot element and a body element, wherein the body element is adjustable by moving the body element relative to the foot element.

8. The device according to claim 7, further comprising a first element and a second element, wherein the first element is configured to clamp the foot element to the body element, and/or wherein the second element is configured to click the foot element into place with the body element.

9. The device according to claim 8, wherein the first element and/or the second element are color-coded, and/or wherein operating elements of the device are color-coded.

10. The device according to claim 1, wherein the arm trainer and/or the leg trainer are rotationally movable by the patient and/or by a motor.

11. The device according to claim 10, wherein the motor is configured to move the arm trainer and/or the leg trainer at 90 revolutions per minute.

12. The device according to claim 1, wherein the different exercising positions are a sitting position and a lying position.

13. A physiotherapeutic device comprising:

a foot element;

a body element, an arm trainer arranged at a first region of the body element; and a leg trainer arranged at a second opposite region of the body element, wherein the arm trainer is configured to rotationally move arms of a patient around a first axis, wherein the leg trainer is configured to rotationally move legs of the patient around a second axis, wherein a distance of the first axis to the second axis is always constant, wherein the first and second axes are height adjustable, and wherein the body element is moveable relative to the foot element along a longitudinal axis of the body element in order to adjust a height.

14. The device according to claim 13, further comprising a first element and a second element, wherein the first element is configured to clamp the foot element to the body element, and wherein the second element is configured to click the foot element into place with the body element.

15. A method for using a physiotherapeutic device, wherein the device comprises an arm trainer for rotationally moving arms of a patient having a first axis and a leg trainer for rotationally moving legs of the patient having a second axis, wherein a distance of the first axis to the second axis is always constant, and wherein the first and second axes are height adjustable, the method comprising:

exercising the arms by the arm trainer and/or exercising the legs by the leg trainer in a sitting position;

adjusting the height of the arm and leg trainers; and exercising the arms by the arm trainer and/or exercising the legs by the leg trainer in a lying position.

16. The method according to claim 15, wherein exercising the arms and/or exercising the legs comprises rotating the arm trainer and/or the leg trainer.

* * * * *